US009556714B2

(12) United States Patent
Hughes et al.

(10) Patent No.: US 9,556,714 B2
(45) Date of Patent: Jan. 31, 2017

(54) LINER HANGER AND METHOD FOR INSTALLING A WELLBORE LINER

(71) Applicant: Resource Well Completion Technologies Inc., Calgary (CA)

(72) Inventors: John Hughes, Calgary (CA); James Wilburn Schmidt, Calgary (CA); Shane D'Arcy, Calgary (CA)

(73) Assignee: Resource Completion Systems Inc., Calgary (CA)

( * ) Notice: Subject to any disclaimer, the term of this patent is extended or adjusted under 35 U.S.C. 154(b) by 530 days.

(21) Appl. No.: 14/090,661

(22) Filed: Nov. 26, 2013

(65) Prior Publication Data

US 2015/0034337 A1 Feb. 5, 2015

Related U.S. Application Data

(60) Provisional application No. 61/861,651, filed on Aug. 2, 2013.

(51) Int. Cl.
*E21B 43/10* (2006.01)

(52) U.S. Cl.
CPC ..... *E21B 43/10* (2013.01)

(58) Field of Classification Search
CPC ..... E21B 43/10
See application file for complete search history.

(56) References Cited

U.S. PATENT DOCUMENTS 4,688,642 A * 8/1987 Baker ..... E21B 23/01 166/208
4,750,564 A * 6/1988 Pettigrew ..... E21B 23/006 166/123
5,086,845 A * 2/1992 Baugh ..... E21B 23/01 166/206
5,318,131 A * 6/1994 Baker ..... E21B 23/04 166/207
5,553,667 A * 9/1996 Budde ..... E21B 21/10 166/156
6,877,567 B2 * 4/2005 Hirth ..... E21B 43/10 166/118
2003/0205387 A1 11/2003 Simpson et al.
2010/0155084 A1 6/2010 Watson et al.
2012/0247767 A1 10/2012 Themig et al.
2013/0180715 A1 * 7/2013 Harris ..... E21B 23/01 166/285

FOREIGN PATENT DOCUMENTS

WO 2012/134705 A2 10/2012

OTHER PUBLICATIONS

Innicor Completion Systems; Line Hanger Equipment; Model 'RLPH' Rotating Liner Packer, Product Nos. 727, p. 7 of 18; May 25, 2007.
Innicor Completion Systems; Line Hanger Equipment; Model 'HS-SL' Hanger System p. 8 of 18; May 25, 2007.
BJ Services; www.bjservices.com; VCH-H1 Single-Cone Hydraulically Set Hanger; Feb. 2009.

* cited by examiner

*Primary Examiner* — John Kreck
(74) *Attorney, Agent, or Firm* — McDonnell Boehnen Hulbert & Berghoff LLP

(57) ABSTRACT

A liner hanger assembly to run-in a liner on a liner hanger, cement the liner in place and set the liner hanger in one trip. Then, a wellbore treatment process can proceed while the running string remains downhole or via a second trip. The liner hanger assembly includes a liner hanger running tool and a liner hanger.

8 Claims, 7 Drawing Sheets

LINER HANGER AND METHOD FOR INSTALLING A WELLBORE LINER

FIELD

The present invention is directed to a wellbore tool and method and, in particular, tools and methods for installing a wellbore liner.

BACKGROUND

In non-monobore completions there is often a requirement to install a larger, uphole (often called surface) casing to provide hole support and a larger bore for other equipment. In such completions, there may be a liner with a smaller diameter installed below the larger casing inside the open-hole. To anchor and seal this liner within the wellbore from surface an established practice is to set the liner on a liner hanger above the casing shoe of the uphole casing. A substantial number of applications leave the liner in an open hole bore beneath the casing but there is also a common requirement to cement the liner in place. Hence the ability to cement through the liner hanger is an important feature.

SUMMARY

In accordance with a broad aspect of the present invention, there is provided a liner hanger assembly comprising: a liner hanger running tool and a liner hanger; the liner hanger running tool including: a tubular body including a base end for connection to a running string, an outboard end and an inner diameter; a connector on the outboard end for releasably engaging the liner hanger, the connector including a first J-type connection structure; and the liner hanger including: a mandrel with an outer surface, an upper end including a running tool connector including a second J-type connection structure for releasable connection with the first J-type connection structure, a lower end including a liner connector and an inner bore passing through the mandrel, extending from the upper end to the lower end; a setting mechanism on the outer surface for setting the liner hanger in a well; and a hydraulic piston for driving the setting mechanism to set in response to a pressure applied through the inner bore and communicated to the hydraulic piston.

There is also provided a method for installing a liner in a wellbore, the method comprising: running into the wellbore with the liner secured to a liner hanger and the liner hanger carried on a running string; positioning the liner hanger and liner in the wellbore; moving cement through the running string, the liner hanger and the liner until the cement fills at least a portion of an annulus between the liner and a wall of the wellbore; pressuring up an inner diameter of the running string and the liner hanger to set the liner hanger in the wellbore; flushing residual cement from an inner bore of the liner hanger and from an annular area above the liner hanger by introducing a flushing fluid from the running string to the inner bore and to the annular area; and allowing the cement to set.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF VARIOUS EMBODIMENTS

Figure 1:
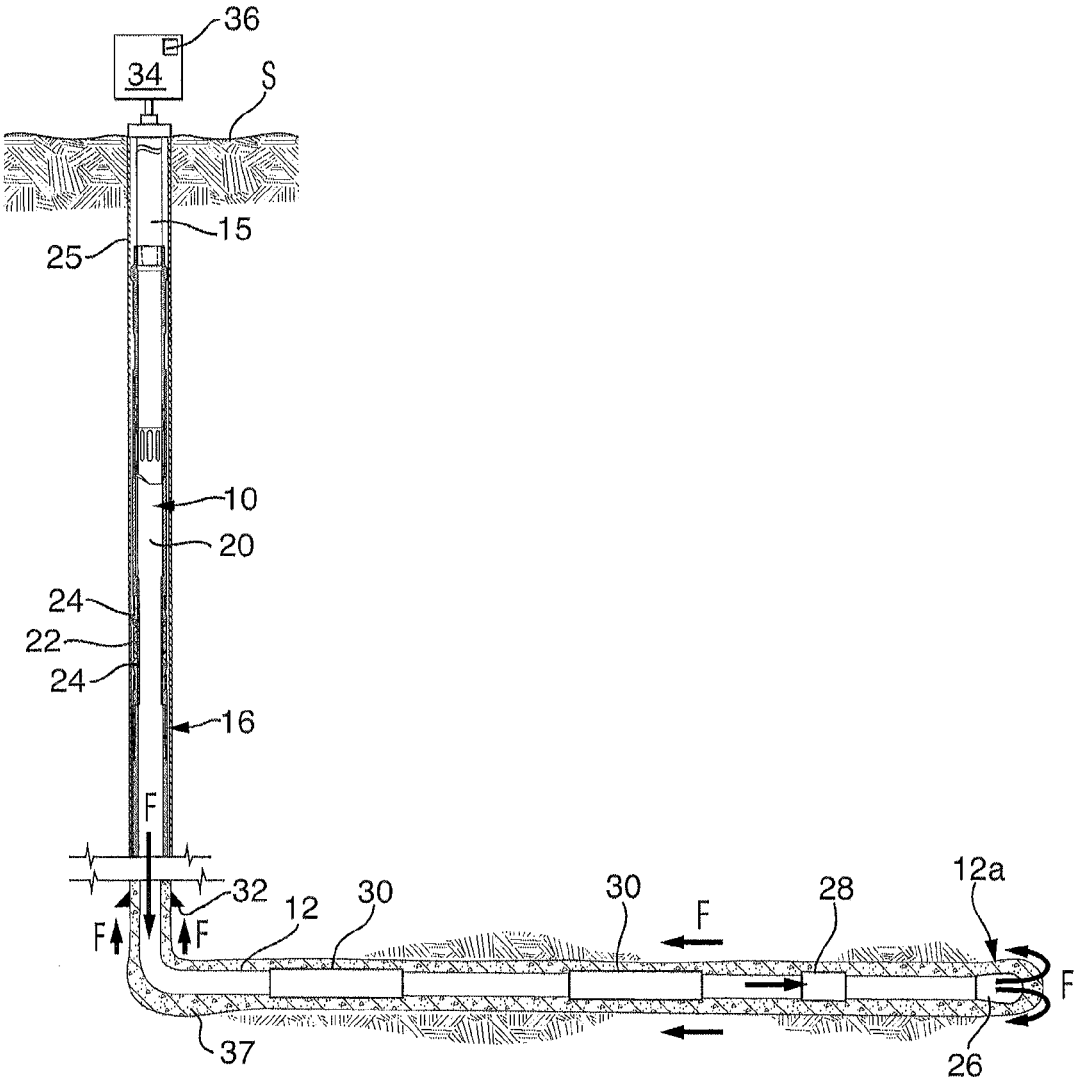
FIG. 1 is a schematic illustration of a wellbore with an uphole casing and a liner being installed therein.

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A liner hanger, liner hanger assembly and method for installing a liner have been invented.

The liner hanger allows cement-through operations and can be set by hydraulic manipulations. The liner hanger is capable of being run and set on either liner or drill pipe. The liner hanger is set in casing above the casing shoe to facilitate hanging a liner beneath, which extends beyond the casing shoe, and provides a seal between the liner and the installed casing. The liner hanger is capable of withstanding the operational parameters of the downhole application such as pressure, temperature and loading conditions.

One embodiment of a liner hanger 10 is shown in FIG. 1. With reference to FIG. 1, the liner hanger is installed at the uphole end of a liner 12 to be installed in a wellbore 14 and the liner hanger is carried on a running string 15, such as of tubing such as, for example, of liner or drill pipe. The liner hanger 10 includes a liner connector 16, a running string connector 18, an inner bore 20 extending through the liner hanger and on the liner hanger's outer surface, a hydraulically actuable setting mechanism, for example, including at least one of a hydraulically settable packer 22 and hydraulically settable slips 24. The connectors 16, 18 permit the liner hanger to be connected between the running string 15 and the liner 12 to be installed. The inner bore 20 permits cement and possibly other fluids to be flowed through the liner hanger. The hydraulically settable packer 22 encircles the liner hanger and permits an annular seal to be set in the annular area about the liner hanger, when it is set in the well. The hydraulically settable slips 24 permit the liner hanger to be secured in the well with the liner hung below it. Since the liner hanger is often secured in a cased section of the well, slips 24 are possibly formed to bite into the material of casing 25.

The liner hanger is employed to secure a liner in a well. The liner hanger can be positioned in the well ahead of a cementing operation. The liner can be cemented into the well by a process where the cement is pumped down through the liner hanger and the liner below it and out from the liner into the annulus, before the cement returns up along the annulus of the liner (to cement the annulus) and passes along the outer surface of the liner hanger before returning back toward surface. The liner hanger may then be set in the well, as by expanding the slips to engage the casing and/or by expanding the packer. The setting operation may be hydraulic, for example by pressuring up the inner bore of the liner hanger to a pressure sufficient to expand the packer and the slips to seal against and bite into, respectively, the casing. After the liner hanger is set, the inner bore may be cleaned of residual cement to ready it for further operations.

The process of positioning, cementing through, setting and cleaning out the liner hanger can be completed in a single trip, if desired. This may reduce complexity, time and cost over a multi-trip system. When compared to mechanically set liner hangers, that are set by string movements, the current liner hanger, which is hydraulically settable by means of simple through-tubing pressure fluctuations, offers simplicity as there are no complex running tools required.

There are many applications of the liner hanger. One such application is for running a horizontal liner for wellbore completions. FIG. 1 shows a typical application, wherein the liner hanger 10 is positioned in wellbore, by being run-in-hole on a running string, which may, as shown, be liner (typically 4" to 6" diameter) with substantially the same inner diameter as inner bore 20 and as that of the liner 12. The liner hanger is located at the appropriate depth in the casing.

The liner 12 includes a toe 12*a* that may be equipped in various ways, may be valved or may be open. In one embodiment, toe 12*a* includes a valve such as a float shoe 26 and/or a float collar 28 for well control and circulation, arrows F, as illustrated in FIG. 1.

It is useful to cement behind the liner as a completion method in multi-stage frac operations. Cementing may provide good zonal isolation and may provide some wellbore support. Thus, while liner 12 can take many forms, a liner that is suitable for multi-stage frac operations is of some interest. Thus, liner may be a simple string of interconnected, bare tubulars or the tubulars may include sites for fracturing, such as multi-stage fracturing, therethrough. Thus, the liner may be bare pipe, for example, used in abrasa-jet or perforating applications or cemented in sleeves/ports 30, as illustrated in FIG. 1. These sleeves/ports 30 can take various forms including (but not limited to): cemented in hydraulic or hydrostatic sleeves, cemented in hydraulic open annular sleeves, hydraulic open burst ports, mechanical open sleeves, ball drop sleeves, etc. These sleeves/ports 30 can function a number of ways and can be opened, for example, using straddle packer tools on coil tubing, mechanical shifting on coil or pipe, ball drop, or any combination thereof. In all these applications, the isolation method between the zones is cement, with or without packers between adjacent ports. This has the advantage of very reliable sealing/isolation and, if without packers, low cost.

While the form of the liner may vary depending on the particular completion method to be employed for the well (i.e. the method that is used to stimulate the individual zones of the well), the liner hanger can be used with these liners.

In a typical application as illustrated in FIG. 1, the liner hanger 10 is assembled with the liner 12 connected therebelow through connection 16. This assembly is run on the running string 15, such as liner as shown, to a desired setting depth above the casing point 32 (i.e. which is the lower end of the uphole casing).

Fluid may be circulated through the well during run-in of the liner and liner hanger. The fluid may be circulated along the route indicated by arrows F. Care may be taken to ensure that the connector 18 between the running string and liner hanger 10 remains engaged. A releasable lock may be employed at connector 18 for this purpose.

With further reference to FIGS. 2A to 2F, once the liner hanger is positioned at the appropriate depth (FIG. 2A), the cementing equipment 34 is then rigged in at surface S. Equipment 34 is then lined up to cement. Equipment 34 may include a cement head manifold containing a liner wiper plug 36, which is contained in the cement head manifold until deployed.

Figure 2A:
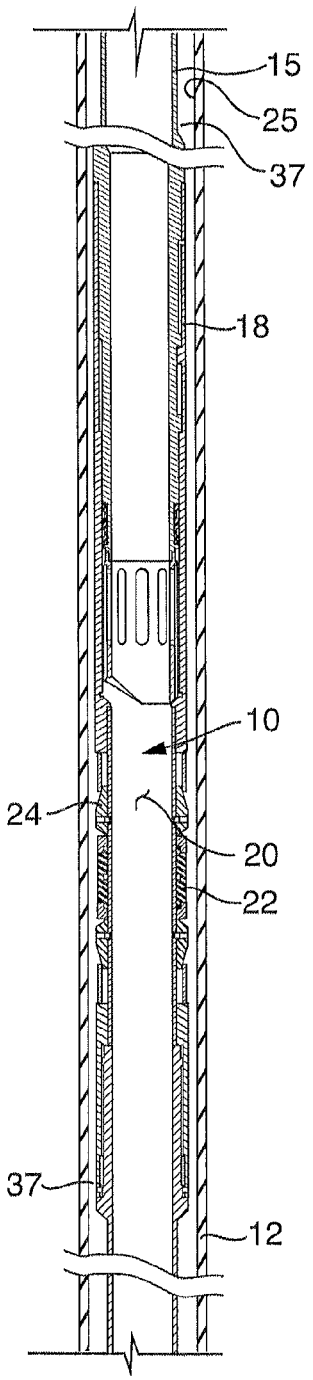
FIGS. 2A to 2F are sections through a wellbore showing sequential operations through a liner hanger.
Figure 2B:
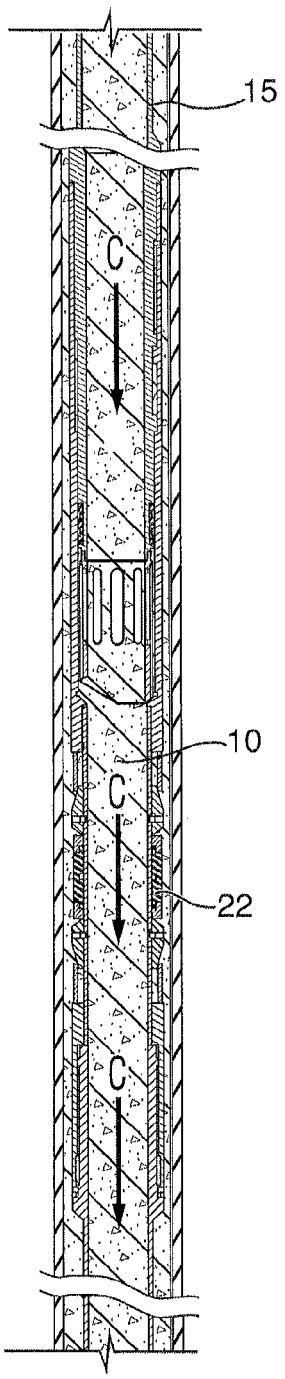

Cement is then pumped down the running string 15, through the liner hanger 10 and out through the toe 12*a* of the liner, for example via the float shoe 26 and/or collar 28. As the cement C exits the toe, it circulates up annulus 37 between the wellbore wall (i.e. open hole below casing point 32 and cased above) and the liner outer diameter (FIG. 1 and FIG. 2B). The cement is circulated and spotted using volume calculations to a point above the unset liner hanger 10.

Figure 2C:
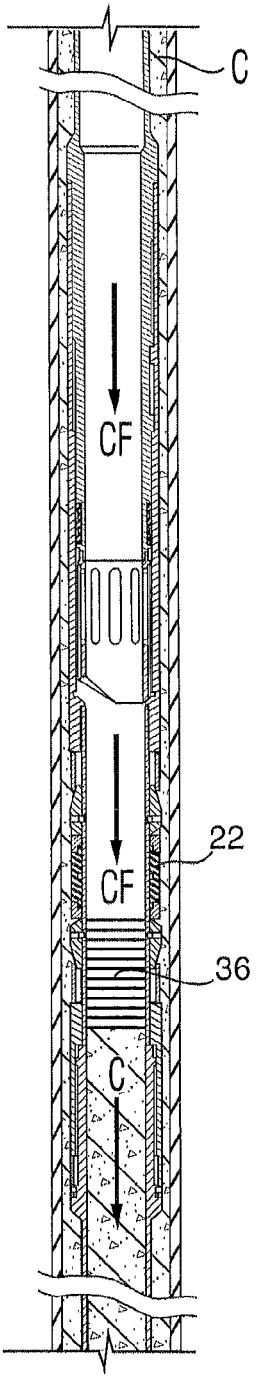

During this process the wiper plug 36 is released from the cement head 34 and acts to wipe the inside of the running string, the liner hanger and the liner clean of cement and acts to separate a chasing fluid CF from the cement C, as shown in FIG. 2C. Eventually the plug lands against a stop, such as a landing collar or the float collar 28/shoe 26 (depending on the liner configuration). During the cementing and wiping processes pressure will be required to circulate the cement and plug 36 and to overcome hydrostatic pressure imbalances, as the cement and chasing fluid will have different densities. Additional pressure may be used to bump the plug to confirm landing on the stop. Once the plug has landed against the stop, cement placement is concluded and the liner hanger can be anchored, as by setting the packer 22 of the liner hanger (FIG. 2D).

The setting mechanism, in its run-in condition (established prior to run-in), is configured not to set during cement pumping operations with an adequate safety margin. Thus, although pressurized conditions are employed during cementing, the liner hanger includes a mechanism to prevent premature anchoring during these operations. In one embodiment, the setting mechanism of liner hanger 10 is set by hydraulic pressure acting against a setting mechanism including a piston. The setting mechanism is selected that allows the piston to move if pressures above a selected level are communicated to the piston. The mechanism can include, for example, shear screws that can only be overcome by a selected hydraulic pressure above those pressures generated during cementing, including pumping of cement and movement of the wiper plug.

Figure 2D:
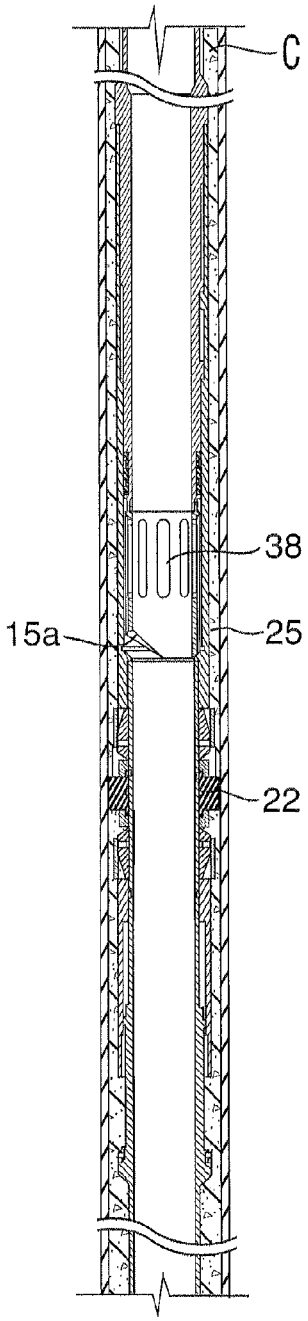

Once plug 36 lands, the liner hanger is pressured up to cause (i) the liner hanger packer 22 to expand out to fill an annular segment of annulus 37 about the liner hanger and to seal against the casing 25 and/or (ii) the slips 24 to expand out and bite into the casing (FIG. 2D). The liner hanger is now set in place in the casing. With the packer set, pressure from the open-hole about liner 12 is isolated from conditions above the packer and the annulus above the liner hanger can be isolated from the liner inside. In addition, tubing movements such as may be driven by temperature, pressure and/or weight effects may be handled and resisted by the liner hanger slips 24 engaging the wellbore wall, which in this embodiment is cased. This prevents the liner string from being moved out of position.

After the liner hanger is set, the pressure may be bled off, for example, to zero.

Figure 2E:
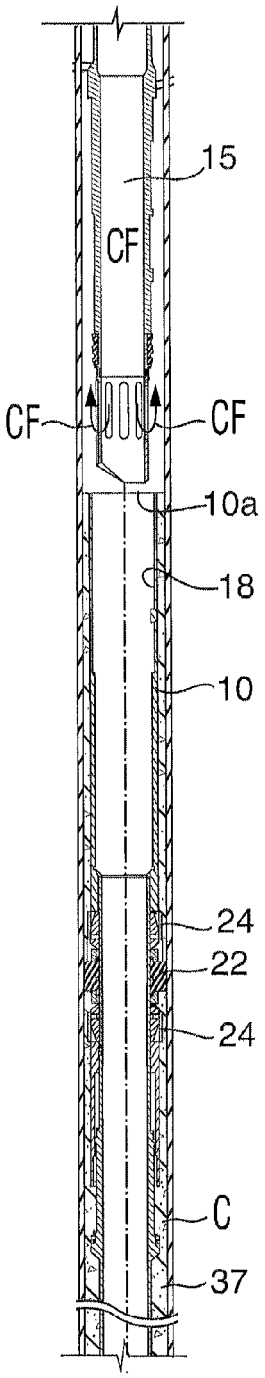
Figure 2F:
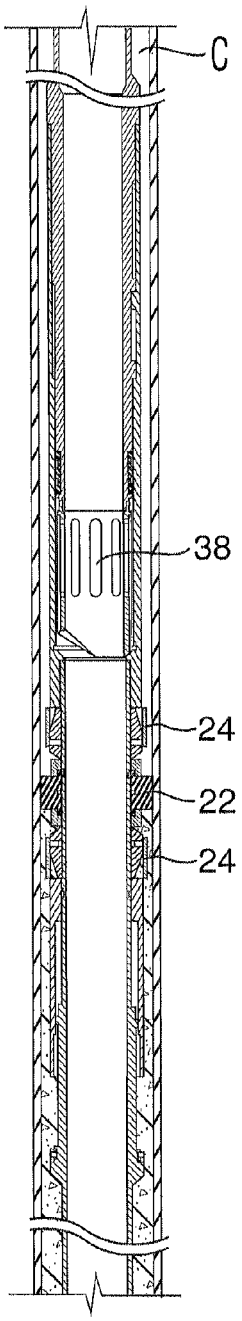

It is now time to clean cement from above the liner hanger and to clean out the inner bore of the liner hanger if it contains cement. In one embodiment, for example, if the liner hanger may contain cement in its inner bore at least at the running string connection and/or if there is residual cement that would interfere with later operations through the liner hanger, the residual cement should be removed. Thus, as shown in FIG. 2E, fluid (arrows CF), may be circulated above the packer 22 and in the liner hanger inner bore to ensure that the area above packer 22 and inner bore 20 are substantially free of cement. To do so, the connection between liner hanger 10 and running string 15 at connector 18 may be disconnected to some degree to create an opening from inner diameter to annulus 37 at the upper end 10*a* of liner hanger 10 and the lower end 15*a* of running string 15 and cleaning fluid may be introduced from the running string through the opening to the outer surface of the liner hanger and into the annulus 37 between the casing 25 running string 15. This cleaning fluid is able to communicate with the annulus between the casing and liner hanger 10 above packer 22.

In one embodiment, running string 15 and/or liner hanger 10 at connector 18 may include ports 38 through their walls such that an opening may be created between the parts without fully separating the running string from the liner hanger.

The cement then is allowed to set to create a seal against the axial passage of fluids along the annulus between the liner 12 and the wellbore wall downhole of the liner hanger 10. In multi-stage operations, the cement provides good isolation between zones and downhole of the liner hanger's packer 22.

After cleaning out the residual cement, the running string can be pulled out or repositioned into (FIG. 2F) liner hanger 10, as required. If desired, the running string can be repositioned into the liner hanger without pulling out of the hole. In such an embodiment, with running string 15 repositioned into liner hanger, once the cement is set, a wellbore stimulation treatment can be conveyed from running string 15, through liner hanger 10 and into liner 12 to stimulate the well.

Figure 3:
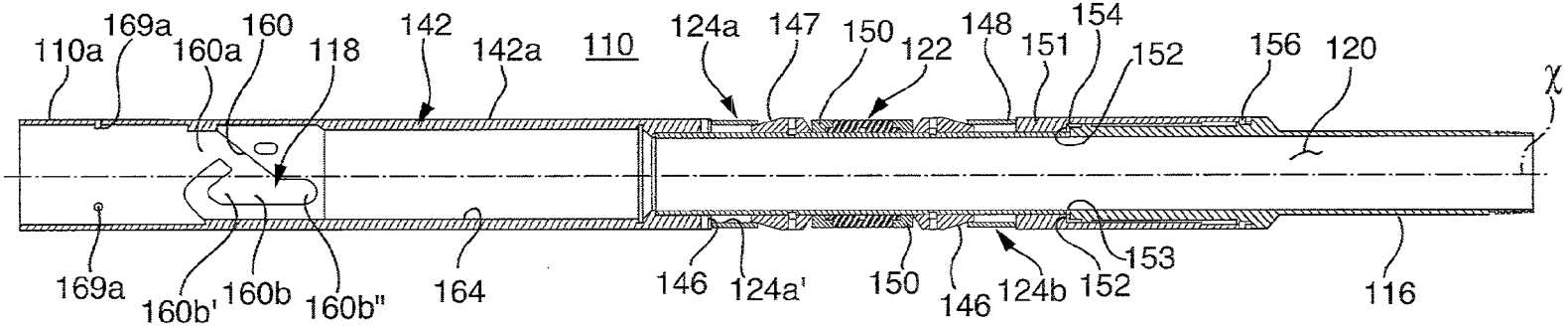
FIG. 3 is an axial section along the long axis of a liner hanger packer.
Figure 4:
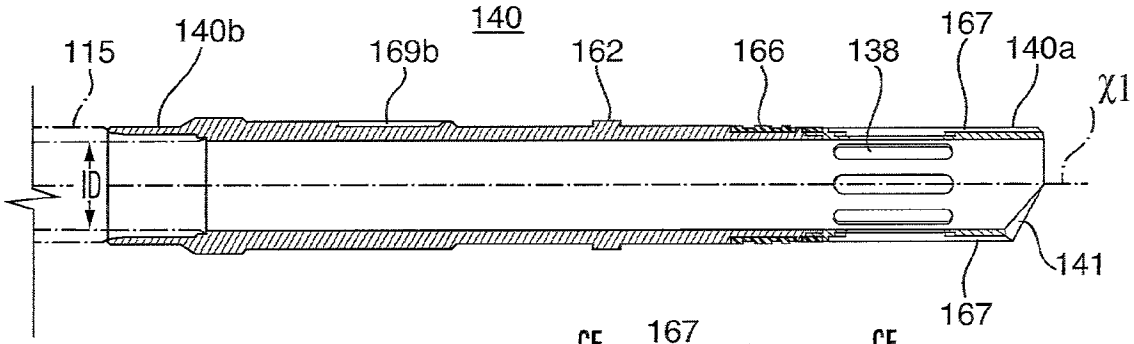
FIG. 4 is an axial section along a carrying tool.
Figure 5:
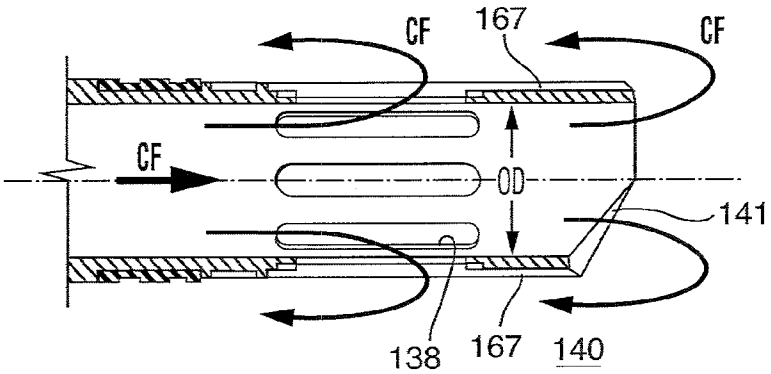
FIG. 5 is an axial section along the carrying tool showing fluid circulation paths.

One embodiment of a liner hanger 110 is shown in greater detail in FIG. 3. The liner hanger of FIG. 3 operates with a running tool, here shown in the form of a stinger 140 (FIGS. 4 and 5). Stinger 140 is carried at the distal end of a running string 115 and operates with the connector 118 of liner hanger 110. Liner hanger 110 and stinger 140 are shown connected in FIG. 6.

Stinger 140 includes an outboard end 140*a* that is intended to make connection with liner hanger 110 and a base end 140*b* through which a connection may be made to the running string 115. Outboard end 140*a* in this embodiment is inserted into the upper end 110*a* of the liner hanger when the stinger 140 and the liner hanger are secured together.

Liner hanger 110 includes a mandrel 142 having a tubular form defining an inner bore 120 extending therethrough and an outer surface 142*a*. Liner hanger 110 carries a packer 122, which is mounted on the outer surface 142*a*, is annular in form to encircle the mandrel and is substantially concentric to the long axis x through the inner bore. Slips 124*a*, 124*b* are also carried on the outer surface, adjacent the packer 122. While a single set of slips may be employed, in this embodiment there are upper slips 124*a* and lower slips 124*b* with the packer 122 therebetween.

Packer 122 and slips 124*a*, 124*b* are normally retracted (as shown) and are settable, to extend radially outwardly to a diameter greater than their retracted diameter, by axial compression of the parts 122, 124*a*, 124*b*. In particular, upper slips 124*a* are positioned against a stop wall 146 that prevents them from moving axially upwardly over mandrel 142. On the other side of the upper slips is a frustoconical surface 147 that is axially moveable toward stop wall 146 to compress the upper slips therebetween. The back sides 124*a*' of the upper slips are formed are ramped such that they can be urged readily to ride up over surface 147, to drive slips 124*a* radially outwardly, when surface 147 is moved toward wall 146 and slips 124*a* are compressed between the surface and the wall.

Packer 122 is a resilient, extrudable annular member that can be compressed between axially moveable retainer rings 150 and extrudes radially outwardly, when compressed.

Lower slips 124*b* are positioned between axially moveable stop wall 148 and frustoconical surface 149. While frustoconical surface 149 is axially moveable toward packer 122, slips 124*b* can be compressed between wall 148 and surface 149. When compressed, the backsides of slips 124*b*, which may be ramped, can be urged over top of the frustoconical surface to become expanded outwardly.

The axial compression of slips 124*a*, 124*b* and packer 122 may be driven by hydraulics, for example by a piston 151 having a piston face 152, which is connected to drive stop wall 148. Hydraulic fluid can be communicated from inner bore 120, through ports 153 to a piston chamber 154 open to face 152. When chamber 154 is pressured up to a degree sufficient to shear a releasable connection, such as pins 156, wall 148 moves to compress slips 124*b* onto frustoconical surface 149, rings 150 against packer 122 and slips 124*a* onto frustoconical surface 147.

The packer piston that accommodate many shear pins 156 to provide pinning flexibility to account for cementing pressures. This means the packer piston can be installed to remain unset until after the cement is positioned correctly. This feature of pinning prevents premature setting of the packer during cementing or pumping operations. It also allows the packer to be set at a comfortable pressure level when the cement is positioned at the correct level in the wellbore.

The upper end 110*a* of the mandrel includes a running string connector 118, herein shown as a J-type connection, which is selected to allow the mandrel to be removably carried on a running string via stinger 140.

The mandrel also includes a liner connector portion 116 selected to permit a liner to be durably connected to the mandrel 142. Herein connector portion 116 is a threaded end, such as a pin, but other configurations are possible.

The running string connector connection 118 is positioned at an upper end of the mandrel and the liner connector 116 is positioned at a lower end of the mandrel. The running string connector places an inner diameter ID of the running string and of the stinger into communication with inner bore 120 and the liner connector 116 places the inner diameter of the liner into communication with the inner bore 120.

The running string connector connection 118 and stinger 140 are connectable to support the mandrel on the running string. As noted above, connection 118 of FIG. 3, is a J-type connection and is durable yet simple to manipulate. One of the stinger or the connection 118 includes a key and the other part includes a J-shaped keyway. In this embodiment, the liner hanger includes keyway 160 and stinger 140 includes key 162. Stinger 140 and the liner hanger can be secured together by axially sliding key 162 into an aligned open end 160*a* of the keyway and allowing or causing the stinger to rotate slightly moves the key into the midportion of the keyway and then into the locking region 160*b* of the keyway. When weight is picked up the key will enter an upper portion 160*b*' of the locking region 160*b* of the J-keyway and when the string is pushed against the liner hanger, the key will reside in the lower portion 160*b*" of the locking region 160*b* of the keyway. Both the upper and the lower portions, 160*b*' and 160*b*", act as traps and prevent relative rotation between the stinger and the liner hanger, and therefore permit transmission of torque, when the connection is in tension or in compression. More than one keyway and key may be employed. For example, in the illustrated embodiment, three keys are spaced apart the same circumference of the stinger and three keyways are spaced apart about the same circumference of the mandrel.

The connection between the stinger and the liner hanger also includes a sealing assembly to substantially prevent fluid from passing out of the inner bore through the interface between the parts when they are connected by the key and keyway. For example, the liner hanger may include a seal bore 164 into which seals 166 on the outer diameter of the stinger outboard end 140*a* can be landed to create a seal with the seal bore. These structures of the sealing assembly allow stinger 140, and therefore running string, to have a substantially fluid tight connection with liner hanger such that the connected parts can hold pressure when connected and even after removal and re-entry of the stinger to the upper end of the liner hanger.

Stinger lower end 140*a* in some embodiments may include a mule shoe end edge 141, which is an angled edge, extending non-orthogonal to the long axis x1, at its end to facilitate insertion of the end into the liner hanger.

Also in some embodiments, outboard end 140*a* includes ports, here formed as slots 138, opening through the wall thickness and at least a portion having a reduced outer diameter, wherein the outer diameter OD at that portion is less than the inner diameter of seal bore 164, to provide space for circulation of fluids between the surfaces. For example, in one embodiment, flutes 167 may be formed on the outer surface of lower end 140*a* between mule shoe end 141 and slots 138. Slots 138 and flutes 167 are positioned between end 141 and seals 166, so they do not affect the sealing operation of stinger 140 into the seal bore. Slots 138 may be positioned close to seals 166 so that during removal of stinger 140 from seal bore 164, slots 138 move out of the seal bore just slightly after the seals.

The connection between liner hanger 110 and the stinger may also include a releasable lock, for ensuring the liner hanger and stinger do not accidentally become disengaged during run in. The releasable lock may include for example a shear connection for example, a shear pin 169*a* that rides in an axial groove 169*b*. Shear connection allows movement of the key in keyway locking region 160*b* and even axial movement therein between ends 160*b*' and 160*b*", but the shear connection resists rotational movement between the stinger and the liner hanger except if sufficient force is applied to overcome the shear connection.

In use, the liner hanger of FIG. 3 is hydraulically set and may be useful for permanent installs.

Figure 6:
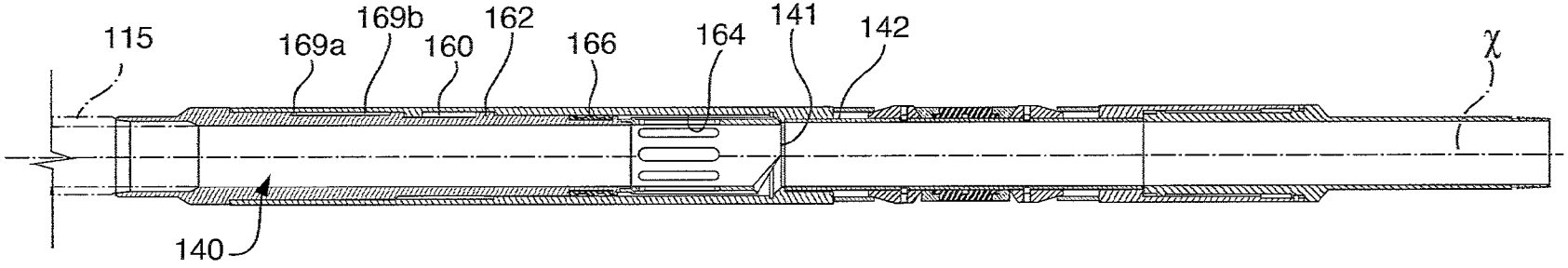
FIG. 6 is an axial section through a carrying tool installed in a liner hanger packer.

To be run into the wellbore, the liner hanger, with the liner connected below, may be connected to the stinger, for example by the connection of the one or more j-keys in the j-keyways (FIG. 6).

When the liner hanger is in a desired position in the wellbore, pumping operations may be initiated. Weight may be set through the running string atop the liner hanger 110 to ensure the liner hanger doesn't move out of position during pumping operations.

Cement is pumped down through the running string, the stinger, the liner hanger and the liner to return up the annulus. Once sufficient cement is pumped to fill a selected portion of the annulus, the liner may be wiped. Liner hanger 110 has sufficient internal clearance in inner diameter 120 to permit the passage of a wiper plug. The wiper plug can be moved down through the liner hanger and liner, pushes cement ahead of it and lands near the toe of the liner. The running string, liner hanger and liner can be pressured up above the plug.

Without removing the stinger from the liner hanger, the packer and slips can be set hydraulically after cementing and after passage of the wiper plug. To do so, tubing pressure may be increased to shear pins 156, which allows piston 151 to compress and expand slips 124*a*, 124*b* and packer 122. The slips and the packer expand out through the liquid cement and engage the casing wall.

After the packer and slips are set, cement may be cleared from above the packer, the stinger may be removed from the upper end, etc., according to the options described above. In one embodiment, fluid may be circulated from the stinger into the annulus above the packer to circulate out the annular cement. To do so, in one embodiment, pressure may be increased slightly in the string to ensure a positive pressure in the inner diameter to avoid flow of the annular cement into the inner diameter 120 and to permit pressure to be monitored to assess the process of stinger/hanger disconnection, the stinger is removed from the liner hanger. With a j-type connection, the stinger is moved down in the liner hanger connection 118, as by setting down weight into the string, and while pulling up, the stinger is rotated back to remove the j-keys from the keyways. This may require that enough torque is applied to overcome the shear connection 169*a*, 169*b* and may require less than a full rotation, for example less than ¾ of a turn or substantially ½ turn, holding the torque in the string to release the stinger. Thereafter, the stinger may be pulled out of the liner hanger packer seal bore. As it comes out, if the string was pressured up, the pressure falls off when the stinger is pulled of the liner hanger, when seals 166 are removed from seal bore 164.

To remove residual cement from above the packer, clean fluid CF (i.e. substantially free of cement) may be circulated as shown in FIG. 5. If the stinger includes slots 138, fluid can pass both through the slots and around end 141. Since slots 138 may be positioned close to seals 166, during removal of stinger 140 from seal bore 164, circulation can be initiated very soon after the seals are free of the seal bore.

Continued circulation as the stinger is removed from the liner hanger, cleans the liner hanger bore 120 of cement that may have not been cleaned from the wiper plug run.

Circulation may continue, for example, till clean returns from the annulus are seen at surface.

At this point, the method may proceed in a number of different ways, in accordance with the plans for further wellbore operations. For example, the running string and stinger 140 may be pulled out of the hole.

Alternately, if further operations through the string 115 are of interest, the string and stinger 140 can be reinserted fully into the liner hanger seal bore 164. If desired, continued circulation of clean fluid, as the packer reenters, circulates out any remaining cement fluid residue and confirms seals 166 have set against the seal bore. If a J-type connection is employed and the keys have been pulled out of the keyways, the stinger may be aligned with the liner hanger and slowly set down. The keys ride in the keyways and are urged toward the locking region 160*b*. A pull test may be employed to confirm that the stinger is correctly connected with the keys engaged in the keyways.

The capability exists, after the cement is set, to frac through the liner below the liner hanger. This can be performed in a single trip without ever having to pull the running string 115 out of the hole, if so desired.

The flexibility also exists, if desired, to remove the running string easily at any time, before or after cementing, for interventions or production pump reasons due to the use of a releasable and reconnectable connection. In particular, the j-type connection, facilitates disconnects and reconnects, requiring less than a full rotation of string 115, which means fewer surface manipulations and less rotation in a horizontal wellbore than a connection requiring one or more full rotations.

Figure 7:
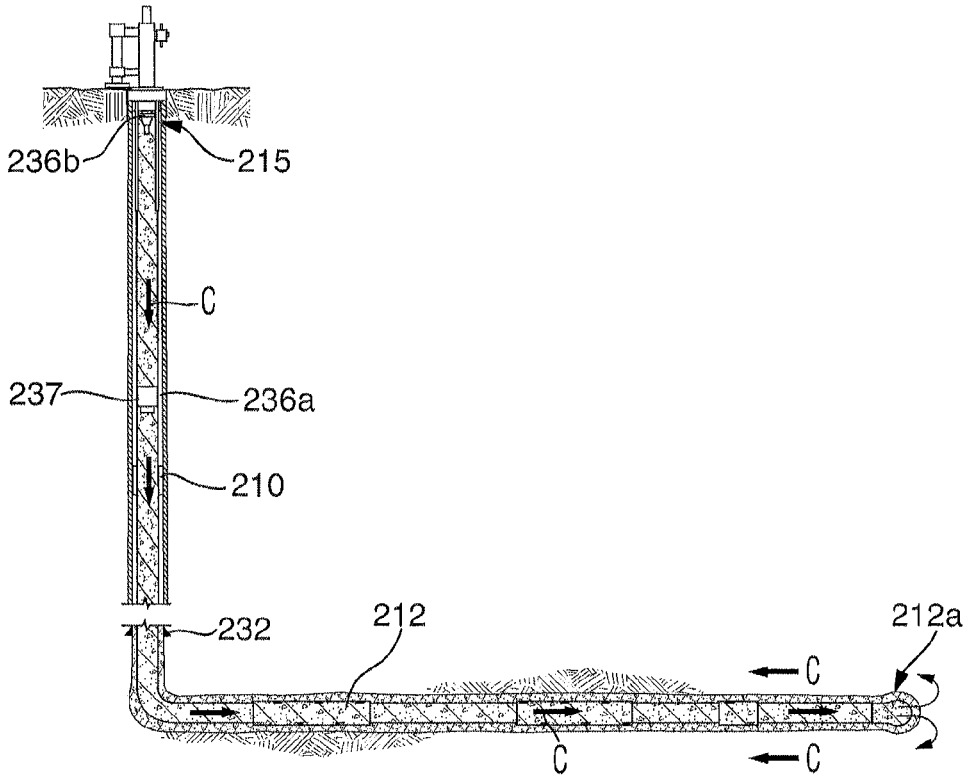
FIG. 7 is a schematic illustration of a wellbore with an uphole casing and a liner being installed therein.
Figure 8:
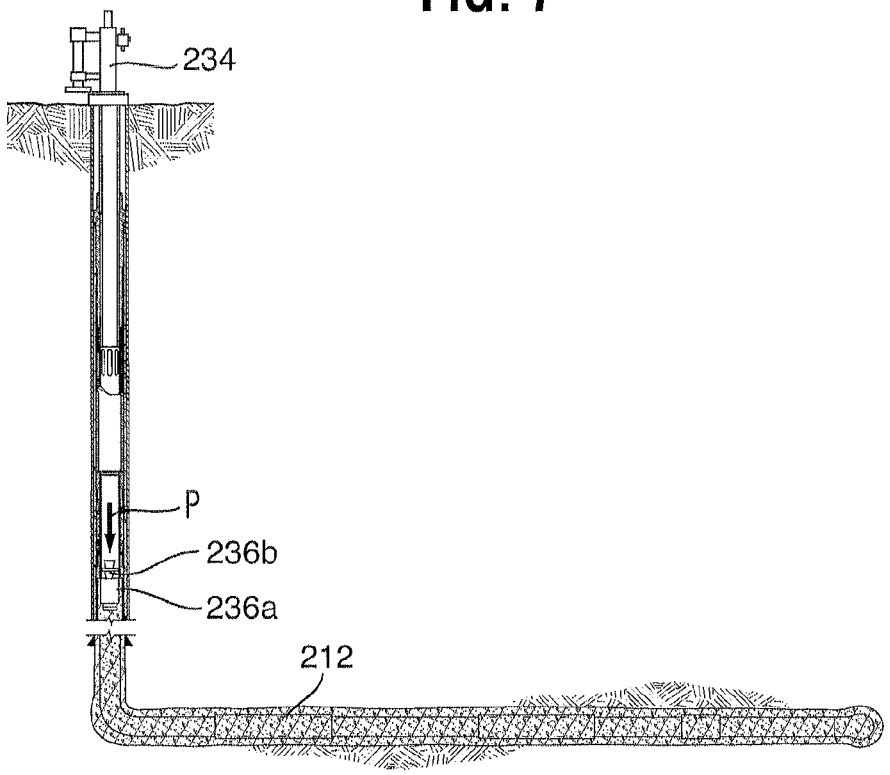
FIG. 8 is a schematic illustration of a wellbore in a process following from that of FIG. 7.

As noted above, the running string may take various forms. While the above-noted embodiments illustrate liner hanger 10, 110 run-in on liner (i.e. wherein the ID of string 115 is substantially the same as the inner diameter through the liner), the liner hanger may alternately be run-in on smaller diameter tubulars such as drill pipe. Thus, FIGS. 7 and 8 show another wellbore assembly wherein a liner hanger 210, similar to those described above, is run on drill pipe 215 instead of liner. The drill pipe can be of standard or heavy weight. Drill pipe may be useful over liner to facilitate running the liner 212 below liner hanger 210 to total depth (TD). This is since drill pipe allows more weight (i.e. force) to be used to position the liner string at the correct depth. For example, sometimes due to the large diameter of the liner string or the wellbore trajectory, drilling drag is significant and prevents the liner string from going any deeper. In such circumstances, additional weight may be required to advance the liner to TD. It is beneficial to look at torque and drag modeling to give an estimation of the amount of weight required due to dog leg severity and wellbore trajectory. In any of these cases, the advantage of drill pipe is that, compared to liner, drill pipe can apply additional weight and has greater flexibility, such that buckling is less of a concern.

In the embodiment of FIGS. 7 and 8, liner assembly includes liner hanger 210 and liner 212 and is carried on drill pipe running string 215 and a compatible ID running tool such as a stinger 240. Stinger 240 may be similar to that stinger of FIG. 4, including for example seals, circulation ports and mule shoe, etc.

In the drill pipe variant of the cement through liner hanger assembly, it may be necessary to employ a two-stage wiper plug installation. In particular, because a wiper plug sized to act in liner 212 could not pass through the smaller diameter drill pipe, a two stage wiper plug installation including a large plug 236*a* and a wiper dart 236*b* may be employed to wipe the liner. On surface there may be a cement manifold containing drill pipe-sized wiper dart 236*b* and large plug 236*a* is installed in the liner assembly. The cement head manifold is attached to the casing and drill pipe and incorporates the drill pipe wiper dart. The dart is held inside the cement manifold till required and can be released upon command.

Large plug 236*a* has a substantially cylindrically shaped body with ends and an outer diameter wiping surface, for example with fins, and which is sized to wipe the inner diameter of liner 212. Large plug 236*a* further includes an axial bore extending through the body from end to end, though which fluids can pass. During run in, large plug 236*a* is installed below the running string in a section having a diameter substantially equal to the inner diameter of the liner. In the illustrated embodiment, the large plug 236*a* is positioned in stinger 240, but may also be installed in liner hanger 210 below running string and stinger 240. For example, liner wiper plug 236*a* may be installed releasably in the inner diameter of stinger or liner hanger or liner, as by use of a shear sleeve 237. Shear sleeve 237 may include a releasable connection, such as a collet, that releasably secures the plug in the inner diameter. Large plug 236*a* is, thus, in place during run-in and cementing operations and fluids such as circulation fluids and cement can pass through its axial bore.

Wiper dart 236*b* is sized to pass through drill pipe and to land in the axial bore of large plug 236*a*. Wiper dart 236*b* is launched from a cement head at surface and acts as a wiper and fluid separation device. Wiper dart 236*b*, after it lands in wiper plug 236*a*, blocks the axial bore and together with plug 236*a* forms a piston that can be sheared out and moved through the liner by fluid pressure to wipe the liner of cement. The combination of wiper plug 236*a* with dart 236*b* engaged therein acts in the same way as plug 36 described above.

In operation, initially the liner assembly including liner hanger 210 and liner 212 is run-in hole carried on a drill pipe running string with a compatible ID running tool.

After the liner assembly is run to depth and located at a desired position above the casing point 232, the equipment at surface is lined up to commence cementing operations.

Cementing operation commences including cementing down the ID of the drill pipe (FIG. 7), through liner hanger 210 and the axial bore of liner wiper plug 236*a*, through liner 212, out the toe 212*a* (including float shoe, etc.) and up the annulus. During this process the drill pipe wiper dart 236*b* is released to clean the drill pipe ID of cement and to act as a fluid separation barrier and then lands into the liner wiper plug. It latches in place into the plug and then, in response to pressure, the liner wiper plug 236*a* and wiper dart 236*b* assembly is sheared from the plug's installed position to be pumped, arrow P, down the liner (FIG. 8). When the assembly lands atop the float collar/shoe at toe 212*a*, it can be bumped to confirm the assembly has landed. The volume of cement pumped ahead of the wiper dart 236*b* is calculated to ensure the cement level is positioned at the correct level, which is usually just above the packer 222 of liner hanger 210.

Figure 9:
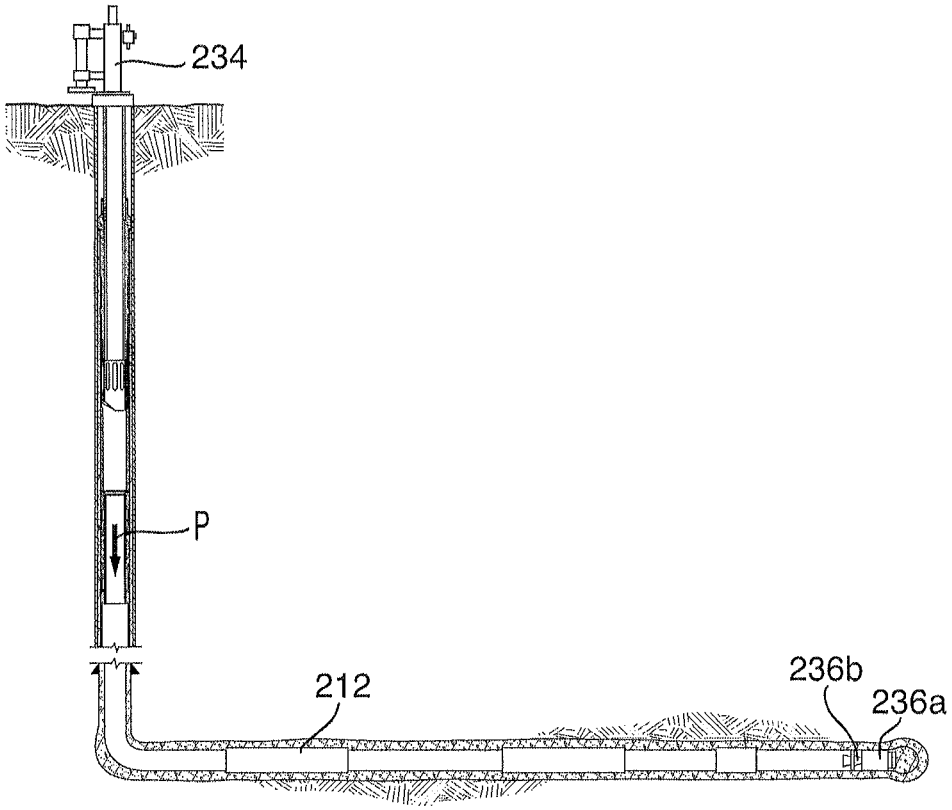
FIG. 9 is a schematic illustration of a wellbore in a process following from that of FIG. 8.

The liner hanger is configured not to set during these pumping and fluid imbalance scenarios via the piston setting feature. However, after the cement has been placed and the liner wiped (FIG. 9), the liner hanger inner bore 220 may be pressured up to set the packer and slips inside the casing. Thereafter, further operations may be undertaken, for example, the pressure may be bled off.

To clear residual cement from the connection 218, pressure may be increased by a small amount (for example, 1.7 Mpa (250 psi)) and in a manner similar to that described above in FIGS. 2E and 2F and FIG. 5, the running string may be released from the liner hanger. For example, the seals at this connection may be released from the receptacle seal bore and circulation may be commenced to clean out residual cement that may be inside the receptacle seal bore and in the annulus above the set liner hanger. This will be done till the circulation shows the clean fluid back at surface from the annulus. Circulation can be continued as the running string running tool is re-inserted into the set liner hanger to clean out any cement fluid residue in seal bore receptacle.

In this embodiment, it is likely that running string 215 is then disconnected and pulled out. Circulation can be continued as running string 215 is pulled out of the hole. The running string is then pulled to surface and the cement is allowed to set.

The option then exists to run-in a frac string with a connector for the liner hanger packer or the full casing ID can be left open for intervention or coiled tubing fracs or other reasons. Thus, while a drill pipe running string does offer some advantages for difficult installations, it does require a two-trip operation for treating through the cemented-in liner.

Liner 212 is shown here with blank pipe ready for completion techniques selected from the abrasive jetting method, coiled tubing frac packer methods, perforating, etc.

Thus, the flexibility exists using the liner hanger to run-in a liner assembly, cement it in place and set the liner hanger in one trip. Then, depending on the running string employed, a wellbore treatment process can proceed while the running string remains downhole or via a second trip (where drill pipe is used as the running string). The process allows the installation and treatment through the liner according to many possible downhole multi-stage completion frac options.

Some of these typical configurations are outlined but use of the described hydraulic set, cement through liner hanger is not limited to these outlined options and has the flexibility to be adaptable for other applications including conventional vertical completions or other applications.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A liner hanger assembly comprising:

a liner hanger running tool and a liner hanger;

the liner hanger running tool including:

a tubular body including a base end for connection to a running string, an outboard end and an inner diameter;

a connector on the outboard end for releasably engaging the liner hanger, the connector including a first J-type connection structure;

and the liner hanger including:

a mandrel with an outer surface, an upper end including a running tool connector including a second J-type connection structure for releasable connection with the first J-type connection structure, a lower end including a liner connector and an inner bore passing through the mandrel, extending from the upper end to the lower end;

a setting mechanism on the outer surface for setting the liner hanger in a well; and a hydraulic piston for driving the setting mechanism to set in response to a pressure applied through the inner bore and communicated to the hydraulic piston.

2. The liner hanger assembly of claim 1 wherein the setting mechanism includes at least one of (i) a packer encircling the outer surface; and (ii) a set of slips on the outer surface and the hydraulic piston drives radial expansion of the packer and/or the set of slips in response to pressure.

3. The liner hanger assembly of claim 1 wherein the first J-type connection structure is a key and the second J-type connection structure is a keyway, and wherein the key is removed from the keyway by less than a full turn of the running tool relative to the liner hanger.

4. The liner hanger assembly of claim 3 wherein the key way includes upper and lower end portions formed as traps to permit transmission of torque from the key to the keyway, when the liner hanger and the running tool are connected in either tension or compression.

5. The liner hanger assembly of claim 1 further comprising sealing structures on the outboard end and the upper end that together form a substantially fluid tight seal when the liner hanger is carried on the running tool.

6. The liner hanger assembly of claim 5 wherein the sealing structures include a polished seal bore in the inner bore at the upper end of the mandrel and an annular seal ring about the outboard end.

7. The liner hanger assembly of claim 6 further comprising circulation ports on the outboard end, the circulation ports extending through a wall of the tubular structure between the annular seal ring and a tip of the outboard end.

8. The liner hanger assembly of claim 1 further comprising a shear sleeve for releasably securing a cementing plug in the inner diameter or the inner bore.

* * * * *